US006572523B2

(12) United States Patent
Herman et al.

(10) Patent No.: US 6,572,523 B2
(45) Date of Patent: Jun. 3, 2003

(54) CENTRIFUGE ROTATION INDICATOR

(75) Inventors: Peter K. Herman, Cookeville, TN (US); Hendrik Amirkhanian, Cookeville, TN (US); Kevin South, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 107 days.

(21) Appl. No.: 09/827,379

(22) Filed: Apr. 5, 2001

(65) Prior Publication Data

US 2002/0147096 A1 Oct. 10, 2002

(51) Int. Cl.[7] ..... B04B 15/00

(52) U.S. Cl. ..... 494/10; 210/87; 116/202; 116/204; 116/264; 116/281

(58) Field of Search ..... 494/1, 9, 10, 49, 494/84; 210/85, 87, 145, 360.1, 380.1, 90, 94; 116/200, 202, 204, 264, 273, 274, 281, 282, 283, 284, 285

(56) References Cited

U.S. PATENT DOCUMENTS

| | | | | |
|---|---|---|---|---|
| 661,943 A | | 11/1900 | Arend | |
| 1,719,522 A | | 7/1929 | Sharples | |
| 3,480,207 A | * | 11/1969 | Strohmaier | 494/10 |
| 3,595,470 A | | 7/1971 | Shapiro | |
| 3,986,663 A | | 10/1976 | Jonsson | |
| 4,012,063 A | | 3/1977 | Sherlock et al. | |
| 4,551,715 A | | 11/1985 | Durbin | 340/671 |
| 4,591,433 A | | 5/1986 | Budzich | 210/114 |
| 4,601,696 A | | 7/1986 | Kamm | 494/10 |
| 4,772,254 A | | 9/1988 | Grassl et al. | 494/10 |
| 4,877,118 A | | 10/1989 | Tamura | 192/103 |
| 4,897,603 A | | 1/1990 | Bieber et al. | 324/208 |
| 5,382,218 A | | 1/1995 | Uchida | 404/10 |
| 5,383,838 A | | 1/1995 | Cheng et al. | 494/10 |
| 5,575,912 A | | 11/1996 | Herman et al. | 210/380.1 |
| 5,637,217 A | | 6/1997 | Herman et al. | 210/380.1 |
| 5,702,592 A | * | 12/1997 | Suri et al. | 210/90 |
| 5,888,184 A | | 3/1999 | Wardlaw | 494/37 |
| 5,961,677 A | | 10/1999 | Scott | |
| 6,017,300 A | | 1/2000 | Herman | 494/49 |
| 6,019,717 A | | 2/2000 | Herman | 494/49 |

FOREIGN PATENT DOCUMENTS

| | | | | |
|---|---|---|---|---|
| DE | 28 07 292 A1 | | 9/1978 | |
| DE | 37 30725 A1 | | 7/1988 | |
| EP | 0 870 462 A1 | | 10/1998 | |
| SU | 728927 | * | 5/1980 | 494/10 |
| WO | WO 98/46361 | | 10/1998 | |
| WO | WO 99/51353 | | 10/1999 | |

OTHER PUBLICATIONS

European Search Report dated Sep. 25, 2002 for European Patent Application No. 02251420.2.

European Search Report dated Aug. 16, 2002 for European Patent Application No. 02250661.2.

* cited by examiner

*Primary Examiner*—Joseph Drodge
(74) *Attorney, Agent, or Firm*—Woodard, Emhardt, Moriarty, McNett & Henry LLP

(57) ABSTRACT

A centrifuge includes a centrifuge housing and a rotor. The housing defines an inner chamber, and the rotor is provided in the chamber. An indicator is provided on the housing. The indicator is constructed and arranged to indicate rotor movement. A rotor sensor is operatively coupled to the indicator, and the rotor sensor is constructed and arranged to sense rotor movement.

26 Claims, 9 Drawing Sheets

CENTRIFUGE ROTATION INDICATOR

BACKGROUND OF THE INVENTION

The present invention generally relates to centrifuge rotation indicators, and more specifically, but not exclusively, concerns a relatively inexpensive centrifuge rotational indicator that is visible during maintenance and is self-powered.

Diesel engines are designed with relatively sophisticated air and fuel filters (cleaners) in an effort to keep dirt and debris out of the engine. Even with these air and fuel cleaners, dirt and debris, including engine-generated wear debris, will find a way into the lubricating oil of the engine. The result is wear on critical engine components and if this condition is left unsolved or not remedied, engine failure. For this reason, many engines are designed with full flow oil filters that continually clean the oil as it circulates between the lubricant sump and engine parts.

There are a number of design constraints and considerations for such full flow filters and typically these constraints mean that such filters can only remove those dirt particles that are in the range of 10 microns or larger. While removal of particles of this size may prevent a catastrophic failure, harmful wear will still be caused by smaller particles of dirt that get into and remain in the oil. In order to try and address the concern over small particles, designers have gone to bypass filtering systems that filter a predetermined percentage of the total oil flow. The combination of a full flow filter in conjunction with a bypass filter reduces engine wear to an acceptable level, but not to the desired level. Since bypass filters may be able to trap particles less than approximately 10 microns, the combination of a full flow filter and bypass filter offers a substantial improvement over the use of only a full flow filter.

While centrifuge cleaners can be configured in a variety of ways as represented by the earlier designs of others, one product which is representative of part of the early design evolution is the Spinner II® oil cleaning centrifuge made by Glacier Metal Company Ltd., of Somerset, Ilminister, United Kingdom, and offered by T. F. Hudgins, Incorporated, of Houston, Tex. Various advances and improvements to the Spinner II® product are represented by U.S. Pat. No. 5,575,912 issued Nov. 19, 1996 to Herman et al., U.S. Pat. No. 5,637,217 issued Jun. 10, 1997 to Herman et al., U.S. Pat. No. 6,017,300 issued Jan. 25, 2000 to Herman, and U.S. Pat. No. 6,019,717 issued Feb. 1, 2000 to Herman, which are hereby expressly incorporated by reference in their entirety.

Even with the advances in centrifuge design, centrifuges are still susceptible to failure due to hostile operating environments. Flooding of the housing can prevent rotation of the rotor in the centrifuge. Damaged bearings and plugged nozzles can also cause the centrifuge to become inoperative. Centrifuge failure is typically not readily apparent since the housing of the centrifuge hides the rotor. If the centrifuge failure is not quickly fixed, contaminants in the oil can build up and cause engine damage or failure before a mechanic is even aware of the problem.

One solution has been to either manufacture or retrofit the centrifuge with a sensor system that monitors rotor operation. A controller unit of the system remotely powers and monitors a centrifuge sensor that is attached to the centrifuge. Once the controller detects that the centrifuge is inoperative, the controller activates a warning signal, such as a dashboard warning light. Due to their complicated design, such types of centrifuge sensor systems are prone to failure and are relatively expensive. Since the remotely located controller supplies power to the sensor, sensing can be disrupted due to loose or cut connections with the controller. With such sensor systems, the centrifuge operation indicator is typically not located in the engine compartment so that a mechanic can not easily determine if the centrifuge is operating properly when performing maintenance on the engine. While improvements have been made in this field, there is still room for additional improvements in this particular area.

SUMMARY OF THE INVENTION

A centrifuge includes a centrifuge housing defining an inner chamber and a rotor provided in the chamber. An indicator is provided on the housing, and the indicator is constructed and arranged to indicate rotor movement. A rotor sensor is operatively coupled to the indicator and is constructed and arranged to sense rotor movement.

A centrifuge according to a further embodiment includes a centrifuge housing defining an inner chamber and a rotor provided in the chamber. A fluid speed sensor is constructed and arranged to sense fluid currents generated by movement of the rotor. An indicator is operatively coupled to the fluid speed sensor, and the indicator is constructed and arranged to indicate movement of the rotor.

One object of the present invention is to provide an improved centrifuge rotation sensor system.

Related objects and advantages of the present invention will be apparent from the following description.

DESCRIPTION OF THE PREFERRED EMBODIMENTS

Figure 1:
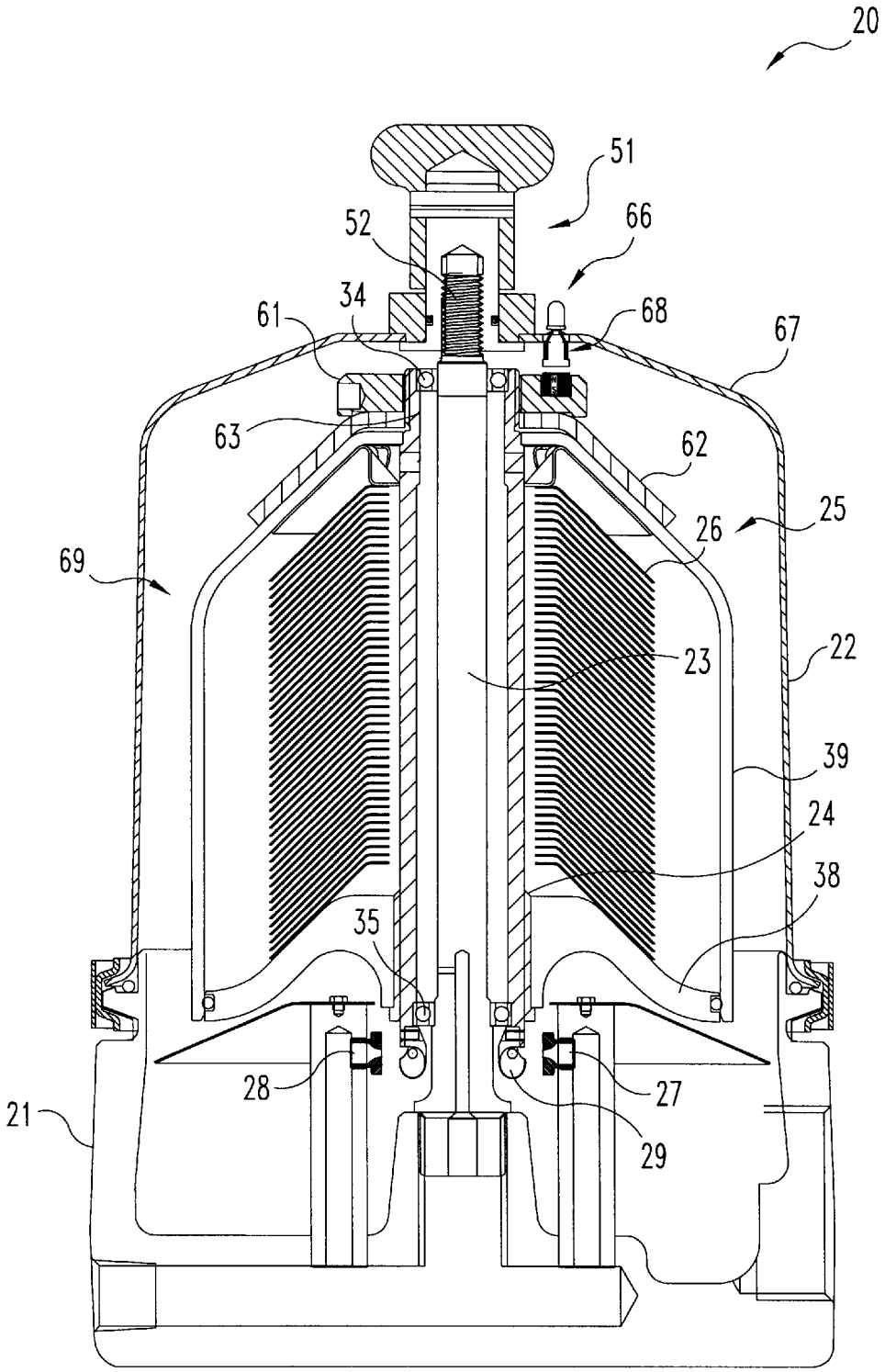
FIG. 1 is a front elevational view in full section of a centrifuge according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as described herein being contemplated as would normally occur to one skilled in the art to which the invention relates. One embodiment of the invention is shown in great detail, although it will be apparent to those skilled in the art that some of the features which are not relevant to the invention may not be shown for the sake of clarity.

Referring to FIG. 1 there is illustrated a self-driven, cone-stack centrifuge 20 according to a preferred embodiment of the present invention. Centrifuge 20 includes as some of its primary components base 21, housing 22, shaft 23, rotor hub 24, rotor 25, cone stack 26, jet nozzles 27 and 28, and turbine 29. Although the present invention will be described in reference to cone-stack type centrifuges, it should be appreciated that the present invention can be used with other types of centrifuges. Except for those portions that will be noted below, the structure of centrifuge 20 is similar in certain respects to the structures disclosed in U.S. Pat. Nos. 5,575,912, 5,637,217, 6,017,300 and 6,019,717, which have been expressly incorporated by reference herein. For the sake of brevity, those structural features and their function not essential to describe the present invention will not be described in detail herein.

The rotor (cone-stack assembly) 25 includes as its primary components base plate 38, rotor vessel shell 39, and cone stack 26. The assembly of these primary components is attached to rotor hub 24 such that as rotor hub 24 rotates around shaft 23 by means of roller bearings 34 and 35, the rotor 25 rotates. The rotary motion imparted to rotor hub 24 comes from the action of turbine 29 which is driven by the high pressure flow out of jet nozzles 27 and 28. As the flow from jet nozzles 27 and 28 impinge on the turbine 29, the rotor 25 rotates at a RPM speed that corresponds to the speed of the turbine 29.

At the top of housing 22, a cap assembly 51 is provided for receipt and support of externally-threaded end 52 of shaft 23. Cap assembly 51 provides axial centering for the upper end 52 of shaft 23 and for the support and stabilizing of shaft 23 in order to enable smooth and high speed rotation of rotor 25. Disposed at the upper end of the rotor 25, between the housing 22 and the externally-threaded end 52, is an attachment nut 61 and support washer 62. The annular support washer 62 has a contoured shaped which corresponds to the shape of the upper portion of rotor shell 39. An alternative envisioned for the present invention in lieu of a separate component for washer 62 is to integrate the support washer function into the rotor shell 39 by fabricating an impact extruded shell with a thick section at the washer location. Upper end 63 of rotor hub 24 is bearingly supported by shaft 23 and upper bearing 34 and is externally threaded. Attachment nut 61 is threadedly tightened onto upper end 63 and this draws the support washer 62 and rotor shell 39 together.

Figure 2:
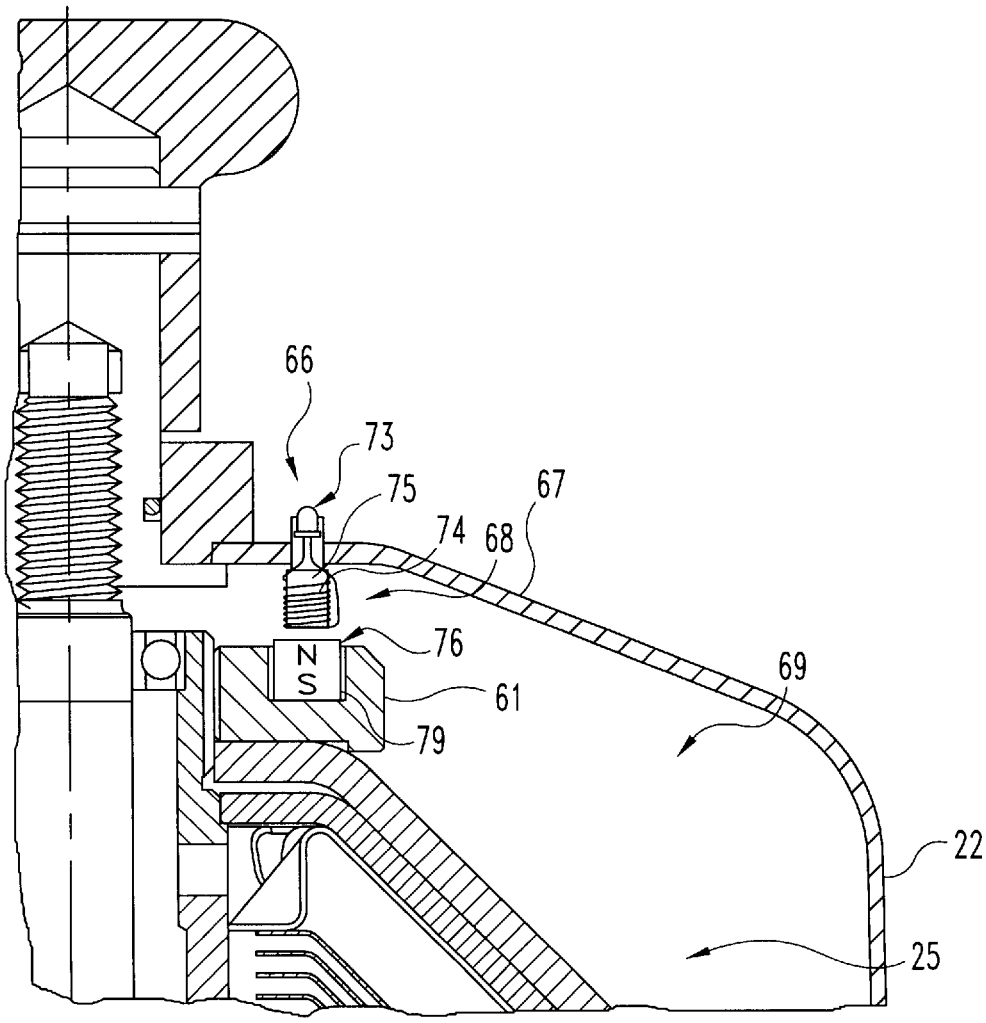
FIG. 2 is a partial front elevational view in full section of a portion of the FIG. 1 centrifuge.

As further illustrated in FIG. 1, the centrifuge 20 has a rotor operation indicator 66 provided on an outside surface 67 of the housing 22. The indicator 66 is positioned on the outside surface 67 of the housing 22 so that the indicator 66 can be easily read. A rotor sensor 68 is provided in an inner chamber 69 that is defined by the housing 22. The sensor 68 is operatively coupled to indicator 66 such that the indicator 66 indicates rotor rotation based on input from the sensor 68. As illustrated in FIG. 2, the indicator 66 includes a light emitting diode (LED) 73. The sensor 68 includes a coil 74 wrapped around a ferrous core 75 and a permanent magnet 76. The ends of the coil 74 are connected to the leads of the LED 73 to form a closed circuit. As shown, the permanent magnet 76 has a substantially rectangular cross-sectional shape and is provided in a cavity 79 of the nut 61. The coil 74 and core 75 are positioned in the inner chamber 69 proximal to the permanent magnet 76 such that as the permanent magnet 76 moves (rotates) as the rotor 25 turns, it induces a current in coil 74. The current induced in the coil 74 powers the LED 73 such that the LED 73 glows. One benefit of this design is that the LED 73 does not need an outside power source to operate, which improves reliability. When the rotor 25 rotates slowly, the LED 73 periodically blinks. As the rotor 25 rotates faster, the LED 73 quickly blinks until the rotor 25 reaches operational speed at which the LED 73 appears to emit a steady glow. During troubleshooting or routine maintenance, a mechanic can simply look at the LED 73 on the centrifuge 20 to see if the centrifuge 20 is operating properly. Although only one of each component 73, 74 and 75 is shown, it should be understood that multiple components can be used.

Figure 3:
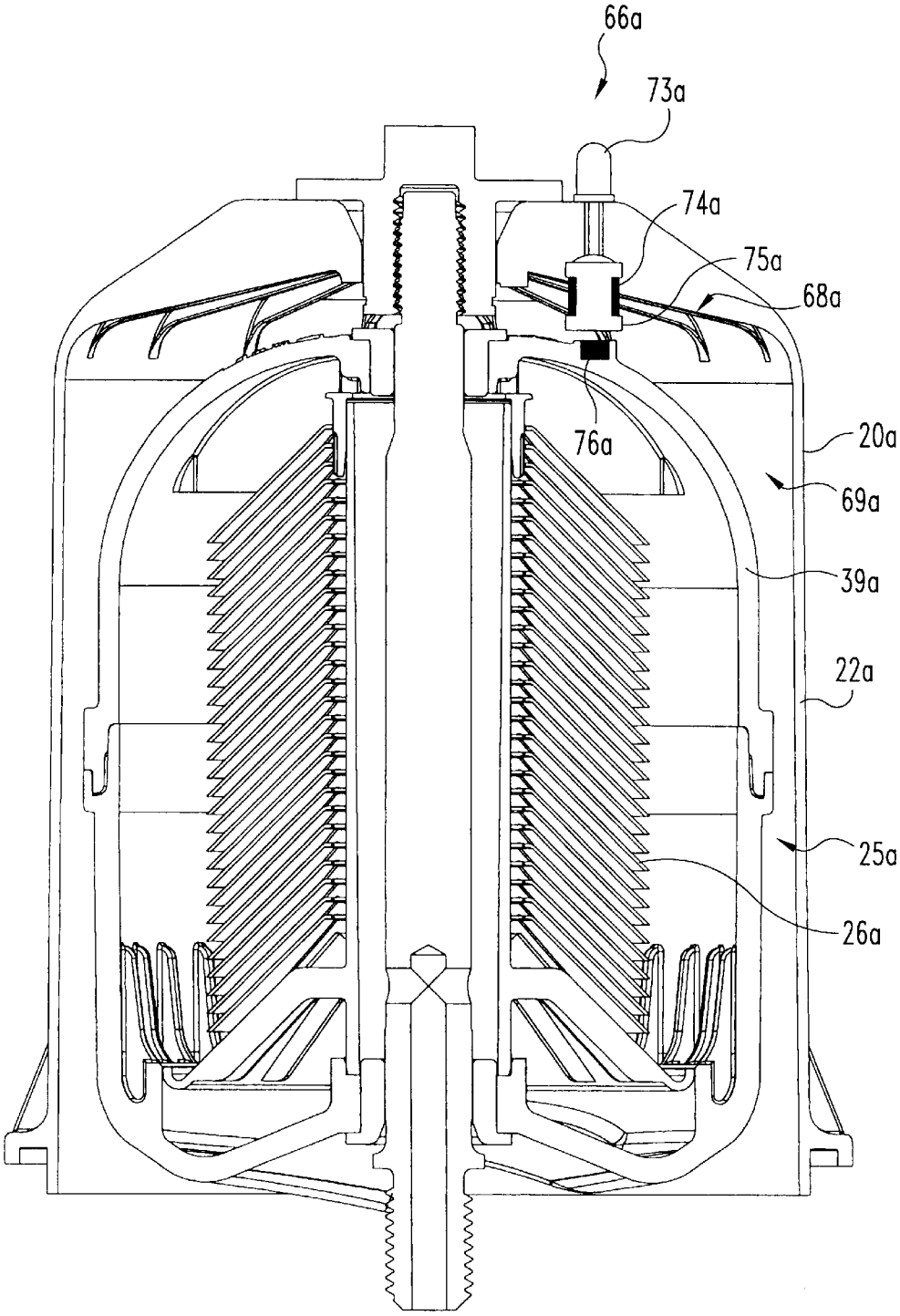
FIG. 3 is a front elevational view in full section of a centrifuge according to an alternative embodiment of the present invention.

FIG. 3 illustrates another embodiment in which centrifuge 20*a* includes a housing 22*a*, a rotor 25*a*, a disposable cone stack 26*a*, and a rotor shell 39*a*. An indicator 66*a* is attached to the housing, and a sensor 68*a*, which is used to detect rotation of rotor 25*a*, extends within inner cavity 69*a*. As illustrated, the indicator 66*a* includes an LED 73*a*, and the sensor 68*a* includes a coil 74*a* and a core 75*a* around which the coil 74*a* is wrapped. In this embodiment, permanent magnet 76*a* is directly affixed to the rotor shell 39*a*. The sensor 68*a* is attached to housing 22*a* proximal to the magnet 76*a*, and the coil 74*a* is operatively coupled to the LED 73*a*. The sensor 68*a* and the indicator 66*a* operate in the same fashion as described above. As rotor 25*a* rotates in chamber 69*a*, the magnet 76*a* induces a current in the coil 74*a*, which in turn causes the LED 73*a* to glow.

Figure 4:
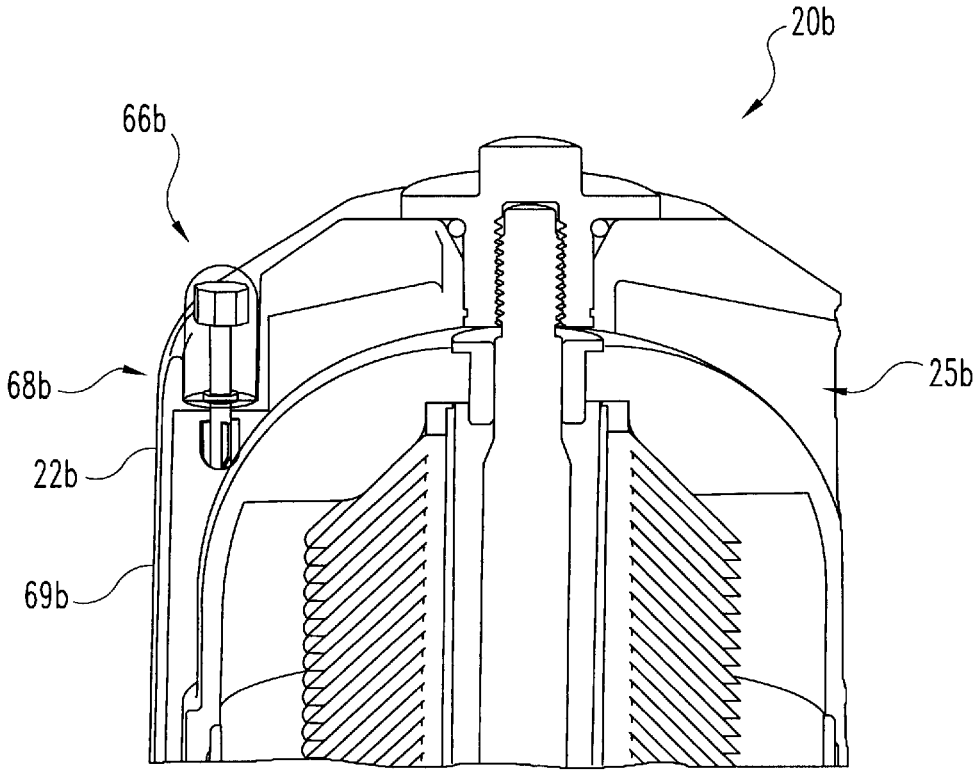
FIG. 4 is a partial, front elevational view in full section of a centrifuge according to another embodiment of the present invention.
Figure 5:
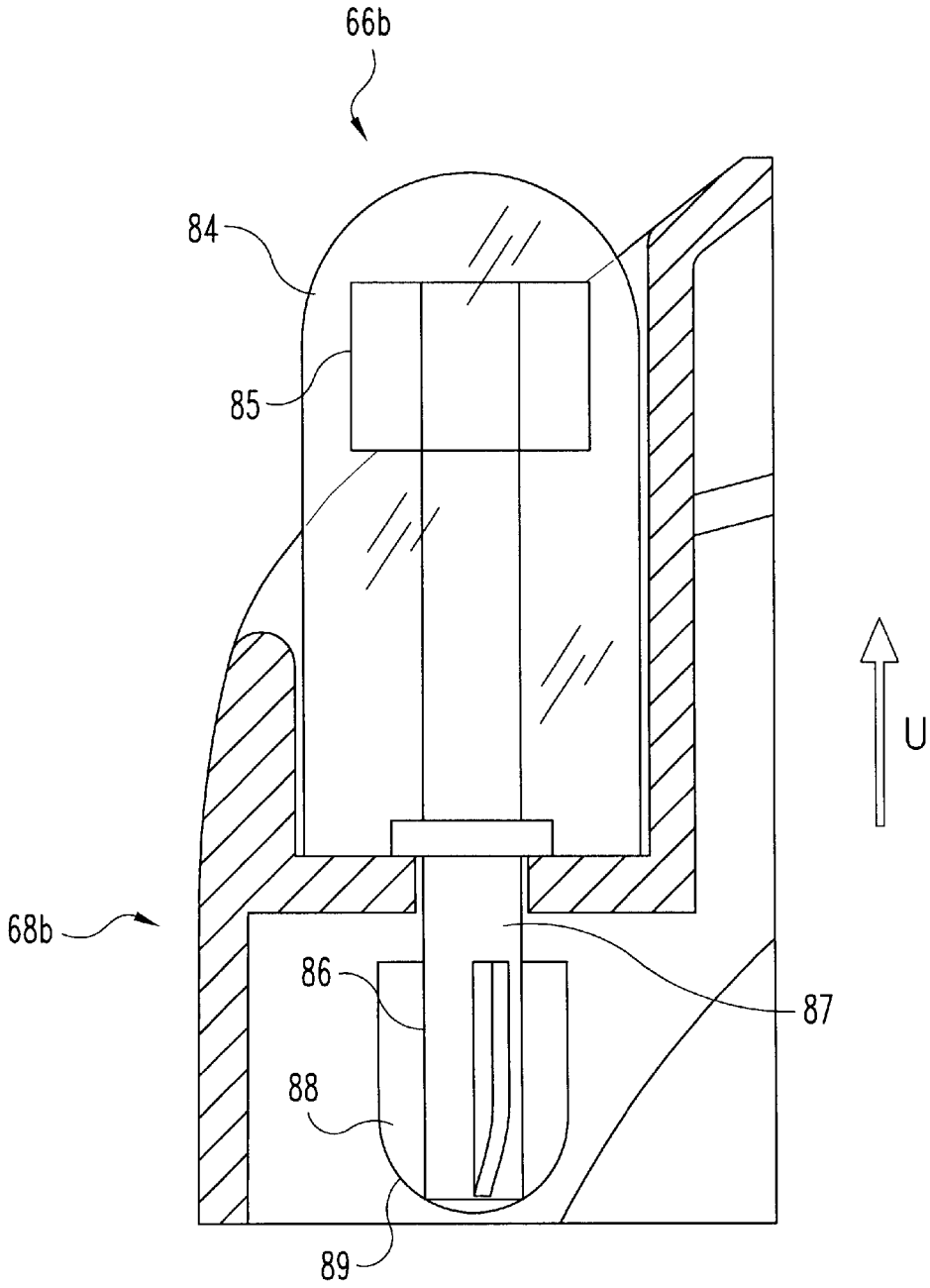
FIG. 5 is a partial, front elevational view in full section of a sensor-indicator assembly which comprises one part of the FIG. 4 centrifuge.

FIGS. 4 and 5 illustrate a further embodiment of the present invention. As shown, centrifuge 20*b* has a housing 22*b* that encloses a rotor 25*b*. In addition, centrifuge 20*b* has an indicator 66*b* and a sensor 68*b* attached to housing 22*b*. In this particular embodiment, the sensor 68*b* is an air speed sensor (fluid speed sensor) that extends in inner chamber 69*b* of the housing 22*b*. Although this and the other embodiments discussed below use air to sense rotor movement, it should be understood that the present invention can be used with other types of fluids besides air. As shown in further detail in FIG. 5, the indicator 66*b* includes a transparent (or semi-transparent) indicator window 84 that houses an indicator flag 85. The sensor 68*b* includes a turbine 86 that is attached to a shaft 87. The shaft 87 connects the turbine 86 to the indicator flag 85. It should be appreciated that the turbine 86 can be operatively coupled to the indicator flag 85 in other manners, such as through gearing in order to adjust the rotational speed of the flag 85. The turbine 86 has blades 88 that are used to rotate the turbine 86, and the blades 88 have curved surfaces 89 that are used to generate lift.

While performing maintenance on the engine, a mechanic can easily read the indicator 66*b* on the centrifuge 20*b* to see if the centrifuge 20*b* is operating. As rotor 25*b* rotates, air within inner chamber 69*b* starts to move. The air within the chamber 69*b* typically moves at speeds from around 30 to 120 miles per hour when the centrifuge 20*b* is fully operational. The air current in the chamber 69*b* causes the turbine 86 to rotate, and at the same time, the curved surfaces 89 generate lift to lift the indicator flag 85 in direction U. As the rotor 25*b* rotates even faster, the speed of the air current increases which causes the indicator flag 85 to rotate even faster and lift even higher. However, if the rotor 25*b* is stationary (inoperative), no air current is generated and the flag 85 is stationary.

Figure 6:
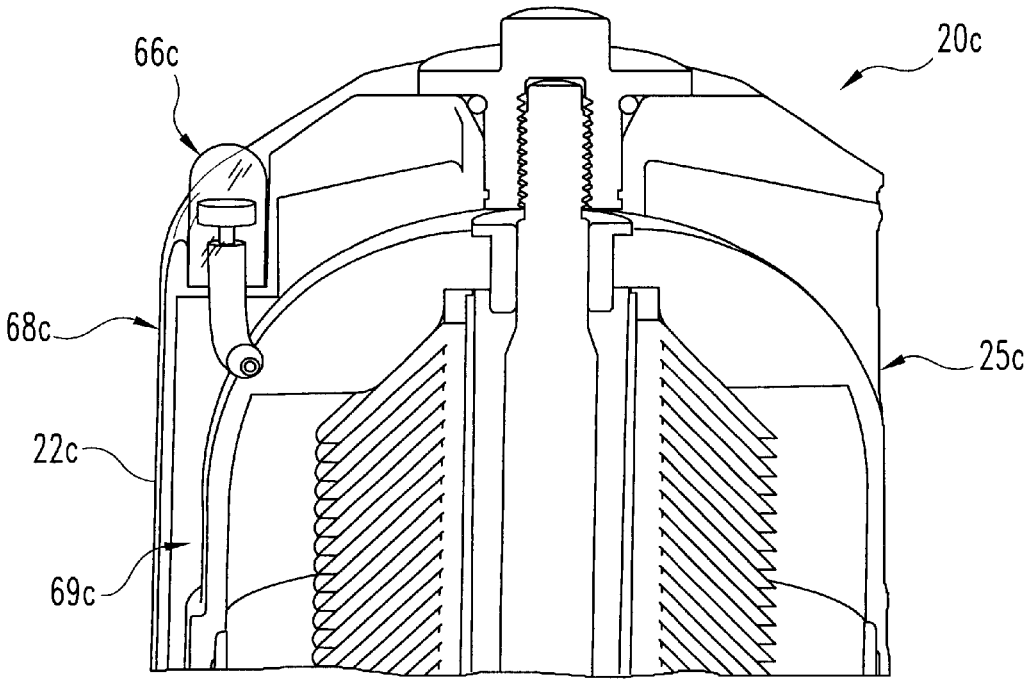
FIG. 6 is a partial, front elevational view in full section of a centrifuge according to a further embodiment of the present invention.
Figure 7:
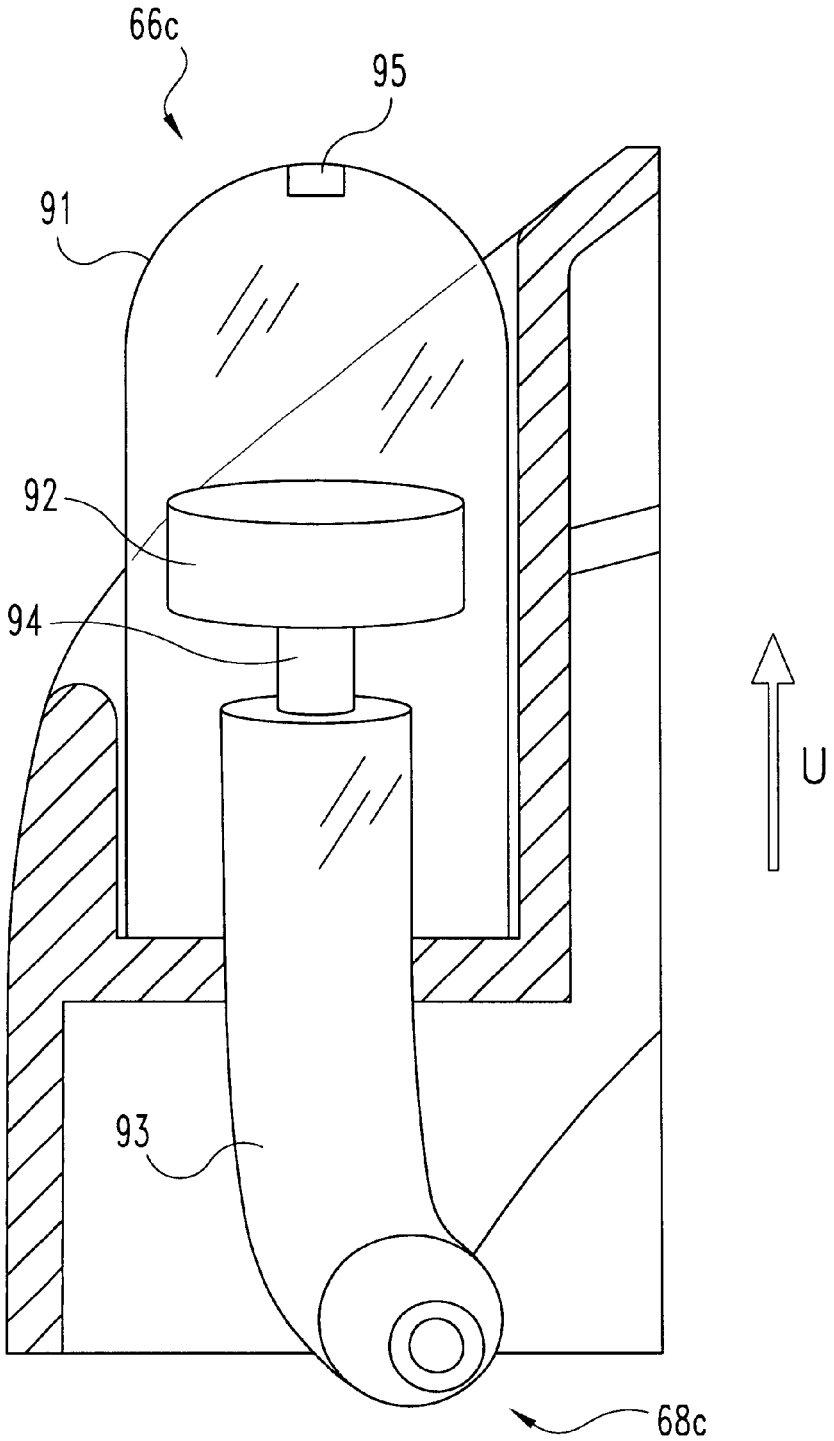
FIG. 7 is a partial, front elevational view in full section of a sensor-indicator assembly which comprises one part of the FIG. 6 centrifuge.

A centrifuge 20*c* according to still yet another embodiment of the present invention is illustrated in FIGS. 6 and 7. The centrifuge 20*c* includes a housing 22*c* and a rotor 25*c*. An indicator 66*c* is attached to the housing 22*c* and a sensor 68*c* extends in an inner chamber 69*c* of the housing 22*c*. As shown in FIG. 7, the indicator 66*c* includes a transparent (or semitransparent) indicator window 91 that houses an indicator piston/flag 92. In this particular embodiment, the sensor 68*c* includes a pitot tube 93 for sensing air (fluid) movement in the inner chamber 69*c*. The indicator piston 92 has a shaft 94 that is slidably received within the tube 93. The window 91 has at least one exhaust hole 95 constructed and arranged to exhaust air to the atmosphere. As the rotor 25*c* rotates, air within the chamber 69*c* pushes the piston 92 upward in direction U to indicate centrifuge operation. In one form, the indicator 66*c* and sensor 68*c* are calibrated so that the height of the piston 92 in the window 91 corresponds to the speed of the rotor 25*c*.

Figure 8:
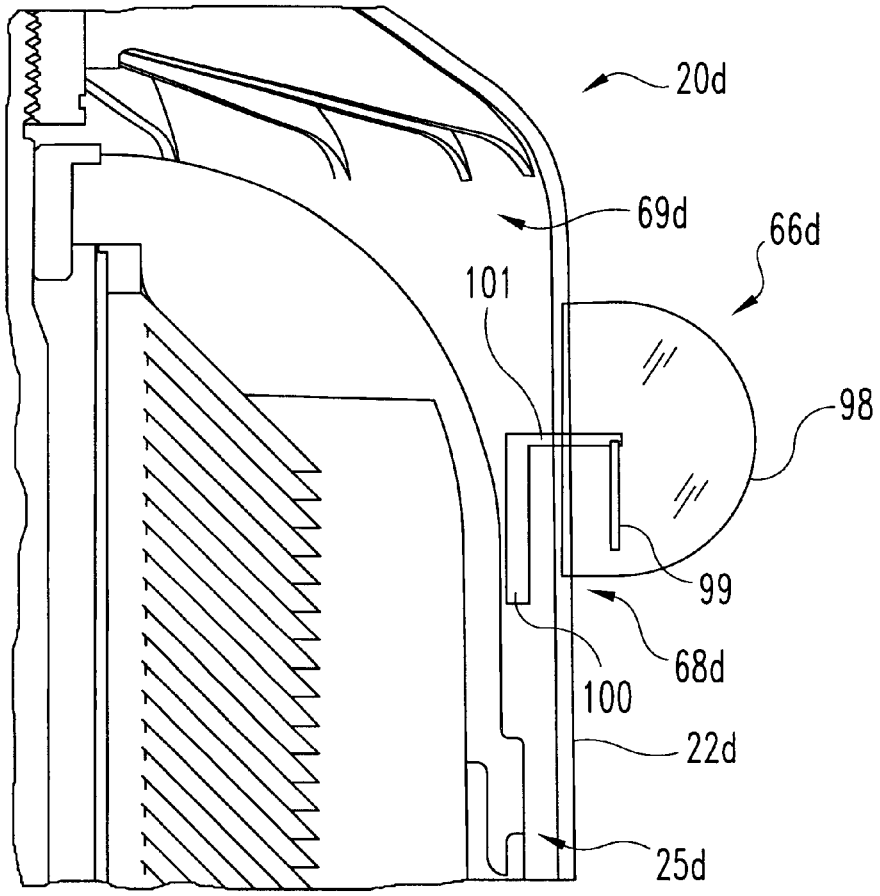
FIG. 8 is a partial, front elevational view in full section of a centrifuge according to another embodiment of the present invention.
Figure 9:
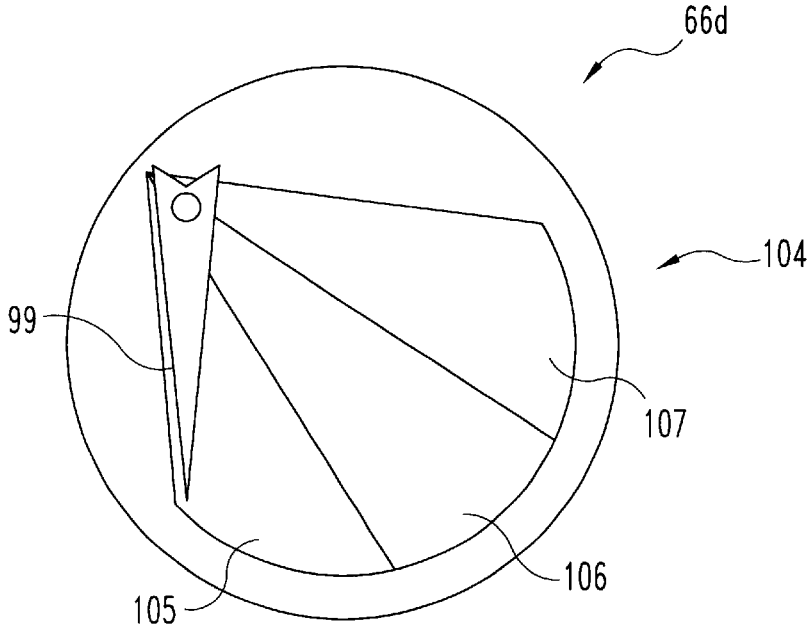
FIG. 9 is a top plan view of an indicator with an indicator needle in a first position which comprises one part of the FIG. 8 centrifuge.
Figure 10:
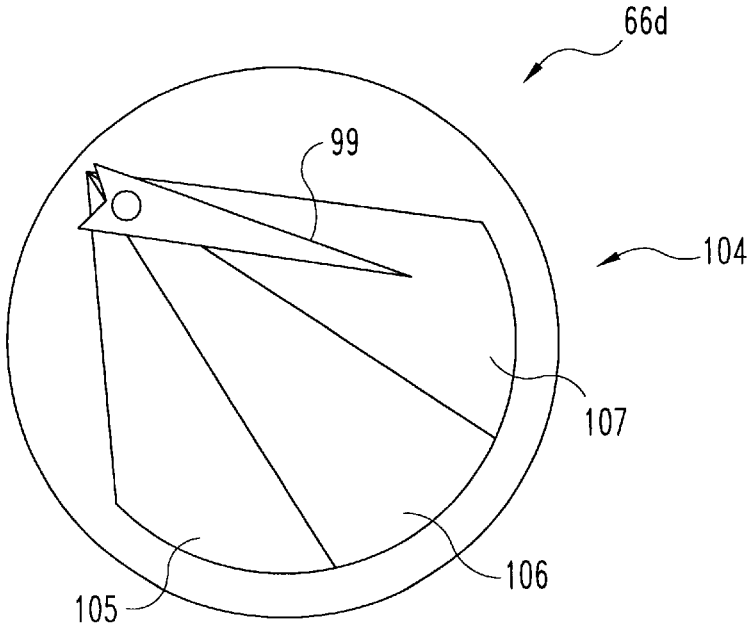
FIG. 10 is a top plan view of the FIG. 9 indicator with the indicator needle in a second position.

Another embodiment of a centrifuge 20*d* that uses air currents to sense centrifuge operation is illustrated in FIGS. 8–10. As shown in FIG. 8, the centrifuge 20*d* includes housing 22*d* and rotor 25*d*. An indicator 66*d* is attached to the housing 22*d*, and the indicator 66*d* is operatively coupled to a sensor 68*d* that is positioned within inner chamber 69*d*. The indicator 66*d* includes an indicator window 98 that houses an indicator needle 99. The sensor 68*d* includes a swinging vane 100 that rotates about a shaft 101. As illustrated, the shaft 101 is attached to the indicator needle 99 so that any deflection of the vane 100 also deflects the indicator needle 99. In this embodiment, the vane 100 is positioned in the centrifuge 20*d* such that gravity biases the vane 100. It should be appreciated that the vane 100 can be positioned at other locations and the vane 100 can be biased in other manners, such as with a spring. As illustrated in FIGS. 9–10, the indicator 66*d* has a number of indicator zones 104 that indicate the relative speed of the rotor 25*d*. Zones 105, 106, and 107 are marked and/or color coded to indicate the relative speed of the rotor 25*d*. When the rotor 25*d* is stationary (inoperative), gravity biases the vane 100 such that the needle 99 is positioned in zone 105, as shown in FIG. 9. As the rotational speed of the rotor 25*d* increases, the vane 100 rotates, and the needle 99 moves through zone 106 to zone 107. When the needle 99 reaches zone 107, as shown in FIG. 10, the rotor 25*d* is operating at the proper speed. It should be understood that the indicator 66*d* can alternatively or additionally have other markings, such as numbers, to indicate the rotational speed of the rotor 25*d*.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A centrifuge, comprising:

a centrifuge housing defining an inner chamber;

a rotor provided in said inner chamber;

an indicator provided on said housing, wherein said indicator is constructed and arranged to indicate movement of said rotor;

a rotor sensor operatively coupled to said indicator, wherein said rotor sensor is constructed and arranged to sense movement of said rotor; and wherein said indicator includes a flag constructed and arranged to indicate movement of said rotor.

2. The centrifuge of claim 1, wherein said flag is constructed and arranged to rotate to indicate movement of said rotor.

3. The centrifuge of claim 1, wherein said flag is constructed and arranged to extend to indicate movement of said rotor.

4. A centrifuge, comprising:

a centrifuge housing defining an inner chamber;

a rotor provided in said inner chamber;

an indicator provided on said housing, wherein said indicator is constructed and arranged to indicate movement of said rotor;

a rotor sensor operatively coupled to said indicator, wherein said rotor sensor is constructed and arranged to sense movement of said rotor; and wherein said indicator includes a needle gauge.

5. A centrifuge, comprising:

a centrifuge housing defining an inner chamber;

a rotor provided in said inner chamber;

an indicator provided on said housing, wherein said indicator is constructed and arranged to indicate movement of said rotor;

a rotor sensor operatively coupled to said indicator, wherein said rotor sensor is constructed and arranged to sense movement of said rotor; and wherein said rotor sensor includes a fluid speed sensor constructed and arranged to sense fluid currents generated by movement of said rotor.

6. The centrifuge of claim 5, wherein said fluid speed sensor includes a turbine.

7. The centrifuge of claim 6, wherein said indicator includes a flag constructed and arranged to rotate to indicate movement of said rotor.

8. The centrifuge of claim 5, wherein said fluid speed sensor includes a swing vane constructed and arranged to swing in response to the fluid currents generated by movement of said rotor.

9. The centrifuge of claim 8, wherein said indicator includes a needle gauge coupled to said swing vane.

10. The centrifuge of claim 5, wherein said fluid speed sensor includes a pitot tube.

11. The centrifuge of claim 10, wherein said indicator includes a flag coupled to said pitot tube, wherein said flag is constructed and arranged to extend in response to movement of said rotor.

12. A centrifuge, comprising:

a centrifuge housing defining an inner chamber;

a rotor provided in said inner chamber;

a fluid speed sensor constructed and arranged to sense fluid currents generated by movement of said rotor; and an indicator operatively coupled to said fluid speed sensor, wherein said indicator is constructed and arranged to indicate movement of said rotor.

13. The centrifuge of claim 12, wherein said fluid speed sensor includes a turbine.

14. The centrifuge of claim 13, wherein said indicator includes a flag constructed and arranged to rotate to indicate movement of said rotor.

15. The centrifuge of claim 12, wherein said fluid speed sensor includes a swing vane constructed and arranged to swing in response to the fluid currents generated by movement of said rotor.

16. The centrifuge of claim 15, wherein said indicator includes a needle gauge coupled to said swing vane.

17. The centrifuge of claim 12, wherein said fluid speed sensor includes a pitot tube.

18. The centrifuge of claim 17, wherein said indicator includes a flag coupled to said pitot tube, wherein said flag is constructed and arranged to extend in response to movement of said rotor.

19. The centrifuge of claim 12, wherein said indicator is attached to said housing.

20. The centrifuge of claim 12, wherein said indicator includes a flag constructed and arranged to indicate movement of said rotor.

21. The centrifuge of claim 12, wherein said indicator includes a needle gauge.

22. A centrifuge, comprising:

a centrifuge housing defining an inner chamber;

a rotor provided in said inner chamber;

a rotor sensor to sense movement of said rotor, said rotor sensor including a coil;

a light emitting diode operatively coupled to said coil to form a closed circuit, said light emitting diode being positioned on said housing for easy visibility;

wherein said rotor includes a magnet constructed and arranged to power said light emitting diode by inducing current in said coil upon movement of said rotor; and wherein said rotor sensor is operable to blink said light emitting diode until said rotor reaches an operational speed at which said light emitting diode appears to glow steadily.

23. The centrifuge of claim 22, wherein said rotor sensor includes a ferrous core around which said coil is wrapped.

24. The centrifuge of claim 22, wherein said rotor includes an attachment nut and said magnet is attached to said nut.

25. The centrifuge of claim 22, wherein said rotor includes a rotor shell and said magnet is attached to said rotor shell.

26. The centrifuge of claim 22, wherein said rotor includes a cone stack assembly.

* * * * *